US005541354A

United States Patent [19]

Farrett et al.

[11] Patent Number: 5,541,354

[45] Date of Patent: Jul. 30, 1996

[54] MICROMANIPULATION OF WAVEFORMS IN A SAMPLING MUSIC SYNTHESIZER

[75] Inventors: Peter W. Farrett; Daniel J. Moore, both of Austin, Tex.

[73] Assignee: International Business Machines Corporation, Armonk, N.Y.

[21] Appl. No.: 269,870

[22] Filed: Jun. 30, 1994

[51] Int. Cl.[6] ..... G10H 1/08; G10H 7/00

[52] U.S. Cl. ..... 84/603; 84/625

[58] Field of Search ..... 84/477 R, 478, 84/622, 623, 624, 625, 627, 603–609, 610

[56] References Cited

U.S. PATENT DOCUMENTS

| | | | |
|---|---|---|---|
| 3,809,786 | 5/1974 | Deutsch . | |
| 3,913,442 | 10/1975 | Deutsch . | |
| 4,194,427 | 3/1980 | Deutsch . | |
| 4,205,580 | 6/1980 | Deutsch . | |
| 4,280,388 | 7/1981 | White . | |
| 4,369,336 | 6/1983 | Agnello . | |
| 4,373,416 | 2/1983 | Endo et al. . | |
| 4,440,058 | 4/1984 | Bass et al. . | |
| 4,622,877 | 11/1986 | Strong et al. . | |
| 4,649,783 | 3/1987 | Strong et al. | 84/1.01 |
| 4,656,428 | 4/1987 | Ishikawa . | |
| 4,763,257 | 8/1988 | Clynes . | |
| 4,763,553 | 8/1988 | Nagai et al. . | |
| 4,967,635 | 11/1990 | Nagai et al. . | |
| 4,999,773 | 3/1991 | Clynes . | |
| 5,025,703 | 6/1991 | Iba et al. . | |
| 5,027,689 | 7/1991 | Fujimori | 84/622 |
| 5,033,352 | 7/1991 | Kellogg et al. . | |
| 5,070,756 | 12/1991 | Abe et al. | 84/618 |
| 5,262,586 | 11/1993 | Oba et al. | 84/723 |
| 5,451,924 | 9/1995 | Massimino et al. | 340/407.1 |

FOREIGN PATENT DOCUMENTS

| | | |
|---|---|---|
| 64-87518 | 7/1979 | Japan . |
| 64-87519 | 7/1979 | Japan . |
| 4-251898 | 11/1991 | Japan . |
| 4-119395 | 4/1992 | Japan . |
| 4-119394 | 4/1992 | Japan . |

OTHER PUBLICATIONS

IBM Technical Disclosure Bulletin, vol. 25, No. 6, Nov. 1982. Audio Frequency Triggered Digital Envelope Generator.

*Primary Examiner*—William M. Shoop, Jr.
*Assistant Examiner*—Marlon Fletcher
*Attorney, Agent, or Firm*—Jeffrey S. LaBaw

[57] ABSTRACT

A technique for producing a sound of a plurality of a selected instrument from a digitized audio sample of the selected instrument. The digitized audio sample of the single selected instrument is stored in a memory. Next, copies of the digitized audio sample are micromanipulated in parallel in a plurality of digital processors corresponding in number to the plurality of the selected instrument. Each of the digital processors processes the digital audio sample in a slightly different time variant manner to produce the effect of a plurality of instruments. The processed digital audio samples are summed into a single digital sample. The summed digital audio sample is converted to an analog signal which is sent to a speaker to produce the sound of the plurality of the selected instrument.

13 Claims, 8 Drawing Sheets

400 BLOCK DIAGRAM SAMPLING MUSIC SYNTHESIZER

MICROMANIPULATION OF WAVEFORMS IN A SAMPLING MUSIC SYNTHESIZER

TECHNICAL FIELD

The present invention relates generally to digital manipulation of audio samples. More particularly, it relates to an improved method for technique for manipulating a digitally sampled audio recording of a single instrument to produce the sound of a plurality of the same instrument.

BACKGROUND OF THE INVENTION

MIDI-controlled music synthesizers using waveform sampling technology are used extensively in the music and multimedia fields for their ability to create musical sounds that closely emulate the sound of acoustical music instruments. MIDI is a music encoding process which conforms to the Music Instrument Digital Interface standard published by the International MIDI Association. MIDI data represents music events such as the occurrence of a specific musical note, e.g., middle C, to be realized by a specific musical sound, e.g., piano, horn, drum, etc. The analog audio is realized by a music synthesizer responding to this MIDI data.

A major limitation of current MIDI music synthesizers is the lack of sufficient memory to store the entire sample of a wide range of an acoustic instrument's sounds. This inability to store many variations of a sound means that the music synthesizer would need, for example, a separate sample for the sound of 1 violin, another sample for the sound of 4 violins, yet another sample for the sound of 12 violins, and so on. Since each sample requires a great deal of memory, most synthesizers on the market offer a limited selection of variations.

This invention allows the synthesizer user to store only the sample of a single instrument, thus avoiding the additional memory requirements to store multiple samples, and to create the sound of a selected number of instruments, 20 violins, for example, without the need of additional memory.

SUMMARY OF THE INVENTION

It is therefore an object of the invention to reduce the storage requirements for a sampling audio synthesizer.

It is another object of the invention to produce the sound of any number of a selected musical instrument from the sampled sound of a single one of the specified instrument.

It is another object of the invention to produce a more interesting sound from a sampling audio synthesizer.

These and other objects are accomplished by a technique for micro manipulating a digitized audio sample of the selected musical instrument producing a sound of a plurality of a selected instrument. The digitized audio sample of the single selected instrument is stored in a memory. Next, for a plurality of instruments, the digitized audio sample is processed in parallel in a plurality of digital processors corresponding in number to the desired plurality of the selected instrument. Each of the digital processors micromanipulates the digital audio sample in a slightly different manner which changes with time to produce the effect of a plurality of instruments. The plurality of digital audio samples are summed and converted to an analog signal which is sent to an audio amplifier and a speaker to produce the sound of the plurality of the selected instrument.

This present invention requires only the storage of a single instrument to obtain the sound of any number multiple instruments.

BRIEF DESCRIPTION OF THE DRAWINGS

These and other objects, features and advantages will be more easily understood in connection with the attached drawings and following description.

DETAILED DESCRIPTION OF THE DRAWINGS

The sound of a single musical instrument differs from the sound of several musical instruments of the same type. To properly create these variations in conventional audio sampling synthesizers, separate audio samples are currently maintained within a music synthesizer thus increasing the memory storage requirements for each set of instruments. The present invention vastly reduces the storage problem by storing the audio sample of a single instrument and manipulating this audio sample data in specific ways to simulate the desired variation.

Figure 1:
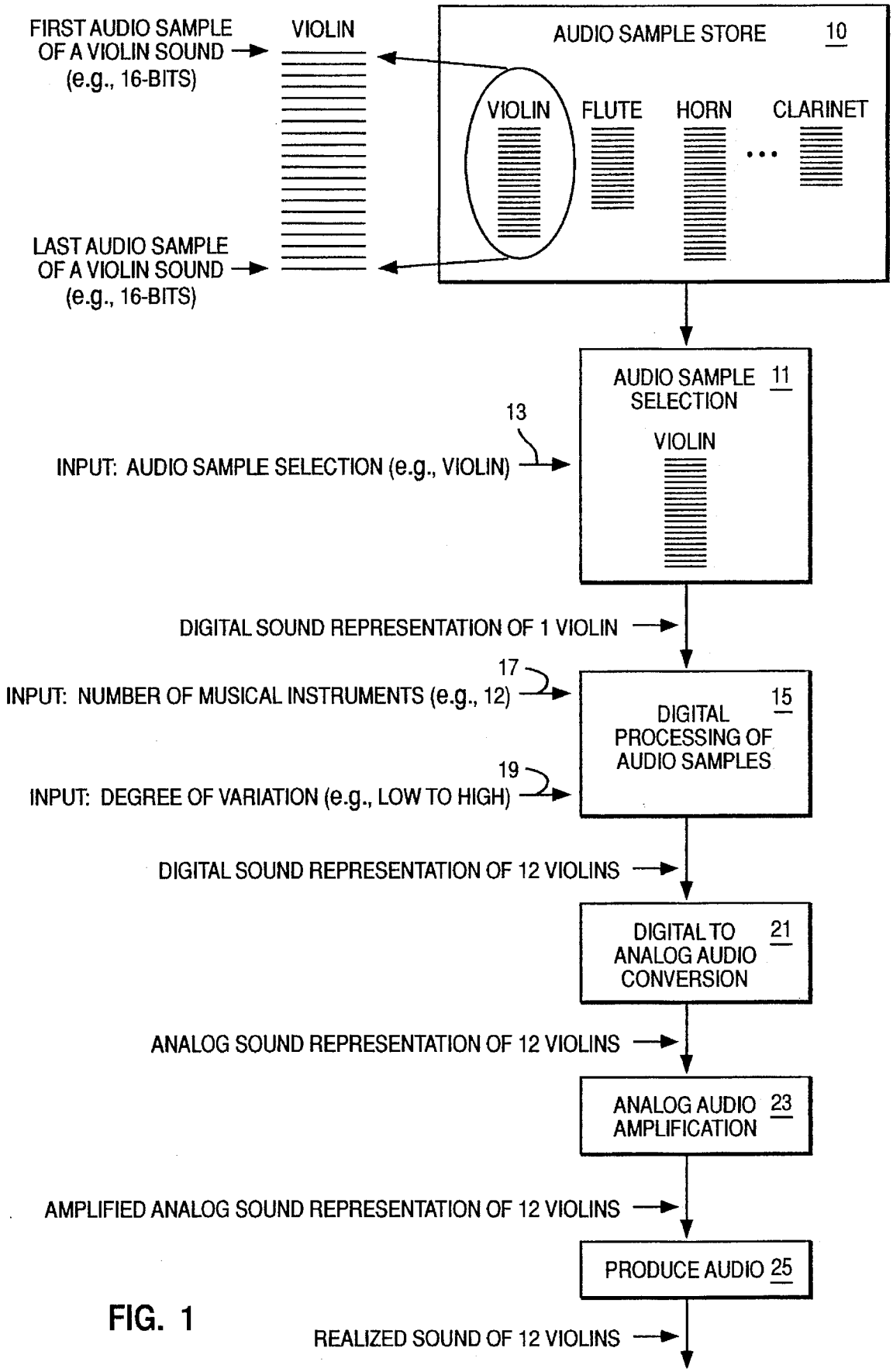
FIG. 1 shows a sampling audio synthesizer process according to the principles of the present invention.

FIG. 1 depicts the audio synthesizer process according to the principles of the present invention. This sampling audio synthesis process could be performed by a special purpose music synthesizer, alternatively, the process could be performed by a combination of software and/or hardware in a general purpose computer.

The audio sample contained in a sampling music synthesizer is a digital representation of the sound of an acoustic instrument. The audio sample may last for 5 to 10 seconds or more depending upon the musical instrument but only a small portion of that sample is typically stored within the music synthesizer. The audio sample of a single musical instrument, a violin, has been stored in the music synthesizer, but the sound of multiple instruments, twelve violins, is desired. This invention manipulates the audio sample of one violin to simulate the sound of twelve violins by manipulating multiple copies of the single violin sample, e.g., by adding a different random, time variant value to the amplitude of each sample copy to simulate the time-based variation between multiple instrument performers. The plurality of manipulated audio samples are then summed to produce a single audio signal that emulates the sound of multiple instruments. This summed audio signal is converted to analog and amplified to produce the sound of twelve violins. This example can be extended to produce the sound of any number of violins all from the original sound of a single violin or any of the other audio samples stored in memory.

Groups of other instruments such as flutes may be created by other samples in memory; the actual sample used depends upon the instrument sound being synthesized. The random amplitude variation is introduced to simulate the natural variation which would occur between the selected number of instrument performers.

The process begins by storing several musical samples in the audio sample memory in step 10. The audio sample memory is either read only memory (ROM) for a synthesizer whose sound capability is not changeable or a random access memory (RAM) for a synthesizer whose sound capability may be altered. The AUDIOVATION™ sound card manufactured by the IBM Corporation is of the altered type since the computer's hard disk memory stores the samples. Synthesizers such as the Proteus™ series by E-Mu Systems, Inc. have a set of samples in 4 to 16 MB of ROM and thus are of the fixed type.

Next, the user or application selects one of the audio samples for further processing, step 11. In the figure, the audio sample selection input 13 is for a violin. The digital sample of the violin is passed to the digital processing step 15, where the number of instruments input 17, in this case, the number of violins, twelve, and the degree of variation input 19 are received. The control is provided over the degree of variation between the simulated twelve violins to match the taste of the user, the style of music being played and so forth.

In the digital processing step, the audio sample is copied to a plurality of processors, corresponding in number to the number of instruments desired. Each of these processors manipulates the sample in a slightly different time-variant manner. The result of these manipulations is summed to form a digital audio sample of the desired number of instruments. The digital processing step 15 is discussed below in greater detail with reference to FIG. 3.

In step 21, the digital sound representation of the 12 violins is converted to an analog audio signal. In step 23, the analog audio signal is amplified. Finally, in step 25, the actual sound of 12 violins is produced by an audio amplifier with speakers or by audio headphones.

Figure 6:
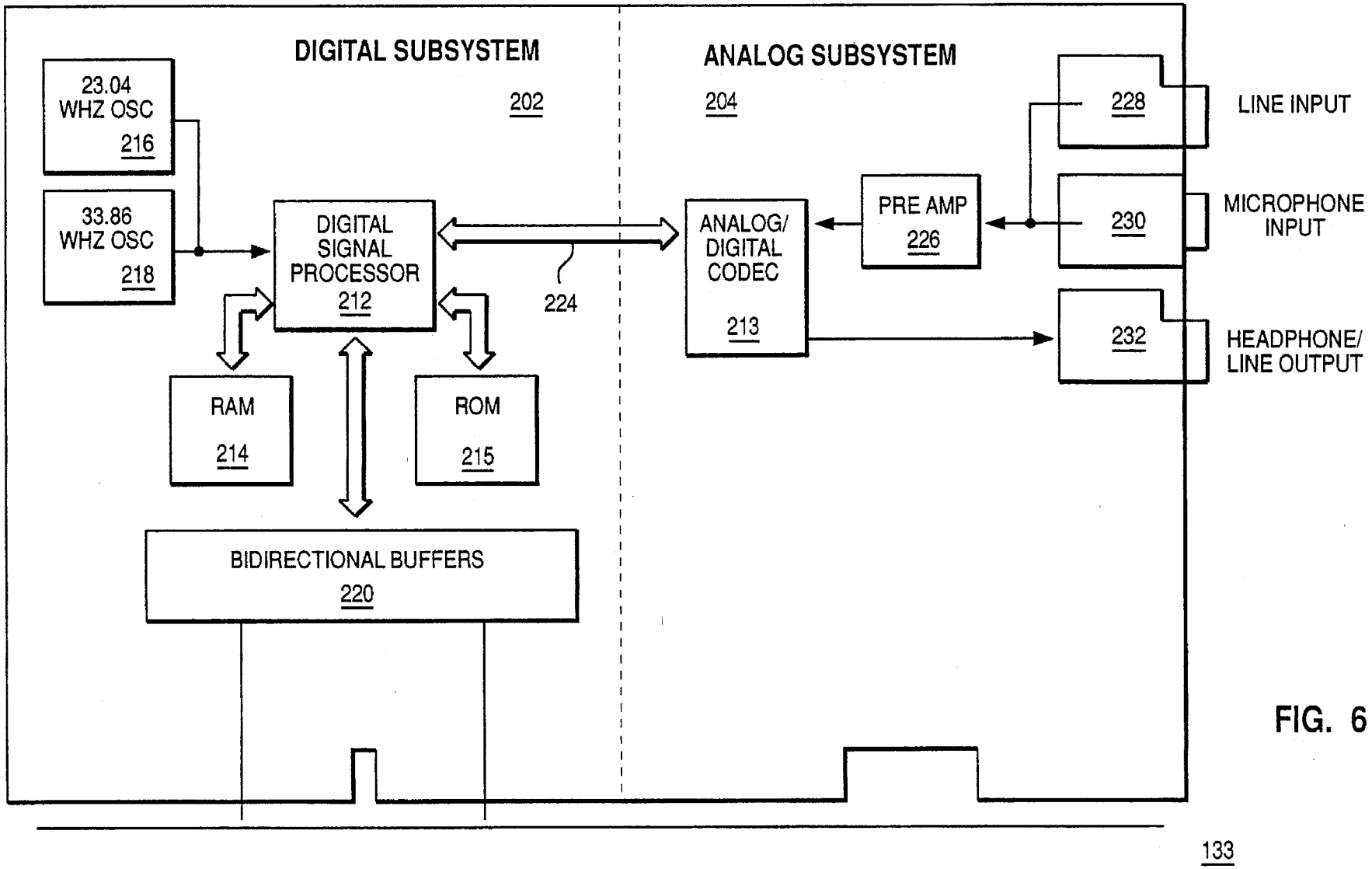
FIG. 6 is a block diagram of an audio card in which the invention is implemented together with the personal computer in FIG. 5.
Figure 7:
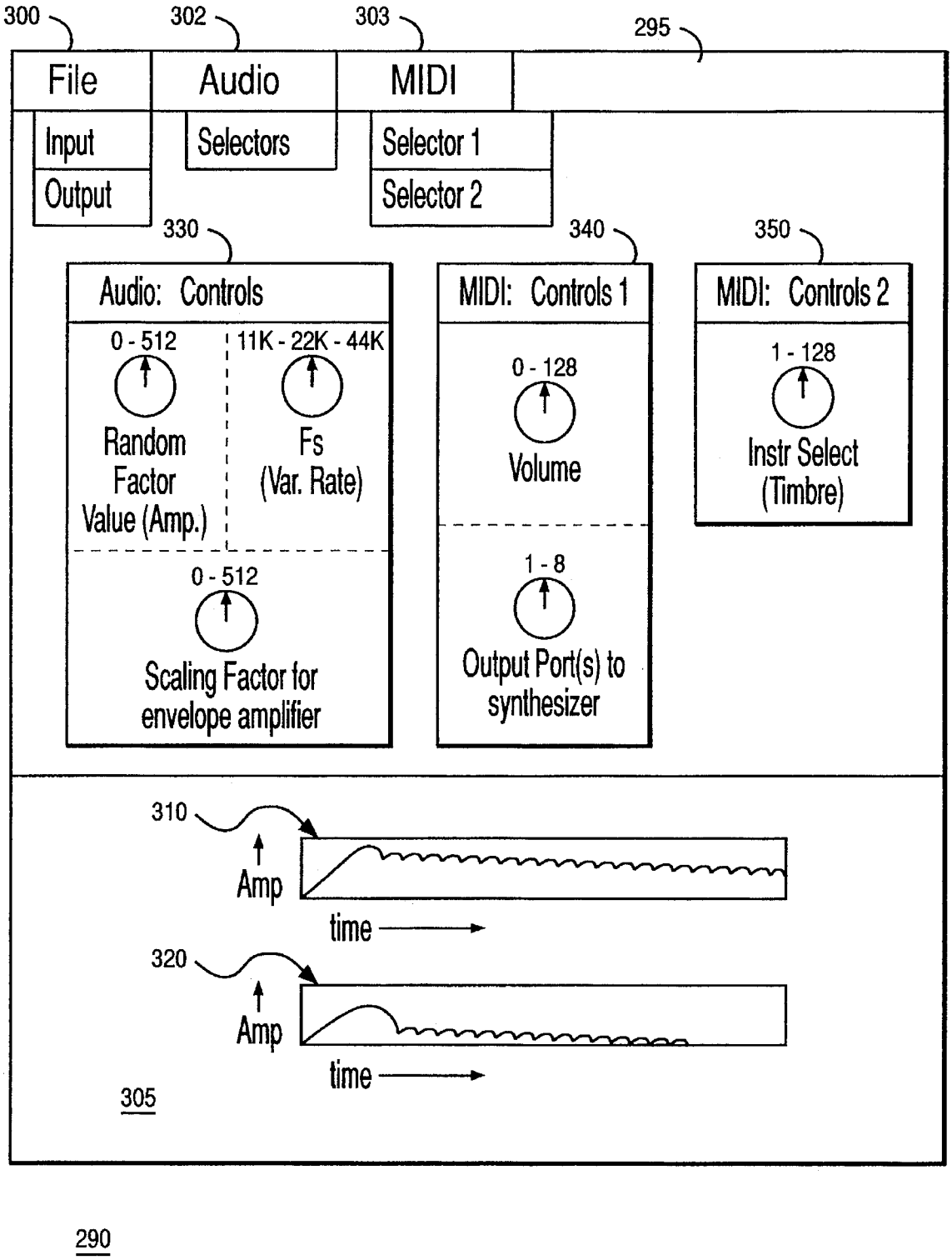
FIG. 7 is a user interface to control the process of the present invention.

In the preferred embodiment, the audio sample storage step 10, the audio sample selection step 11 and the digital processing step 15 are accomplished by computer software programs executed by a computer. The "computer" may be a stand alone general purpose computer equipped with a sound card or built-in sound software or it may be a computer chip within a specialized music synthesizer. The computer and audio card are discussed in greater detail with reference to FIGS. 5 and 6 below. A sample user interface for a computer is shown in FIG. 7. The digital to analog conversion step 21 is typically performed by a dedicated piece of hardware. A typical hardware component for such conversion is a codec, which produces an analog voltage corresponding to digital data values at a specific time interval. For example, 44K digital audio data would be sent to a codec every 1/44,100 seconds and the codec's analog output would reflect each input digital data value. The codec is also used to convert analog audio entering the computer into a digital form. All synthesizers, including multimedia enabled computers, have Digital-to-Analog converters to produce the analog audio signal. For example, a suitable D to A converter is the Crystal Semiconductor Corp's codec chip CS4231. The analog audio amplification step 23 is performed by an analog amplifier. The actual production of sound, step 25, is accomplished by sending the amplified signal to audio speakers or audio headphones. Both the amplifier and the speakers or headphones are normally separate pieces of hardware. They may be incorporated within the chassis of a music synthesizer or multimedia enabled computer, but they are usually distinct units.

One of the primary advantages of this invention is limiting the number of audio samples in the audio sample memory, one of the most expensive parts of a musical synthesizer. Another advantage of the present invention is that a more interesting sound is produced by the synthesizer. Typically, in a synthesizer, the last few samples in an audio sample are repeated over and over and are combined with an amplitude envelope to simulate the natural volume reduction, i.e., decay, of an acoustic instrument's sound. The part of the sound where the repetition starts is thus the same sound repeated over and over at a reducing volume. This sound is very uniform since the same set of audio samples are used and has a very non-musical feel. The sound of an actual acoustic instrument varies in small respects at all times and does not exhibit this repetitious characteristic. This invention modifies each audio sample throughout the amplitude envelope in a digital processor in a time variant manner to provide a much more natural sound.

The process of audio digital sampling is accomplished where an audio waveform produced by a microphone, and possibly recorded on a storage medium, is sampled at specific time intervals. The magnitude of that sample at each point in time is saved digitally in memory. In a computer system, a sample is a binary representation of the amplitude of an analog audio signal measured at a given point in time; a sample really is just an amplitude measurement. By repeated measurements of the analog signal at a sufficiently high frequency, the series of binary representations can be stored in memory and be used to faithfully reproduce the original analog signal by creating an analog voltage that follows the stored values in memory over the time intervals.

The magnitude of the audio data reflects the loudness of the audio signal; a louder sound produces a larger data magnitude. The rate at which the audio data changes reflects the frequency content of the audio signal; a higher frequency sound produces a larger change in data magnitude from data sample to data sample.

Figure 2:
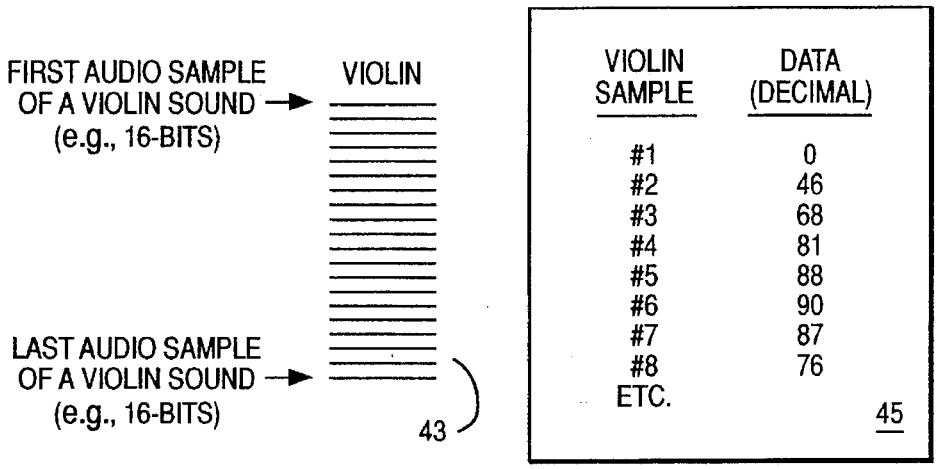
FIG. 2 depicts the process of converting a recorded audio waveform to a digital sample.
Figure 2:
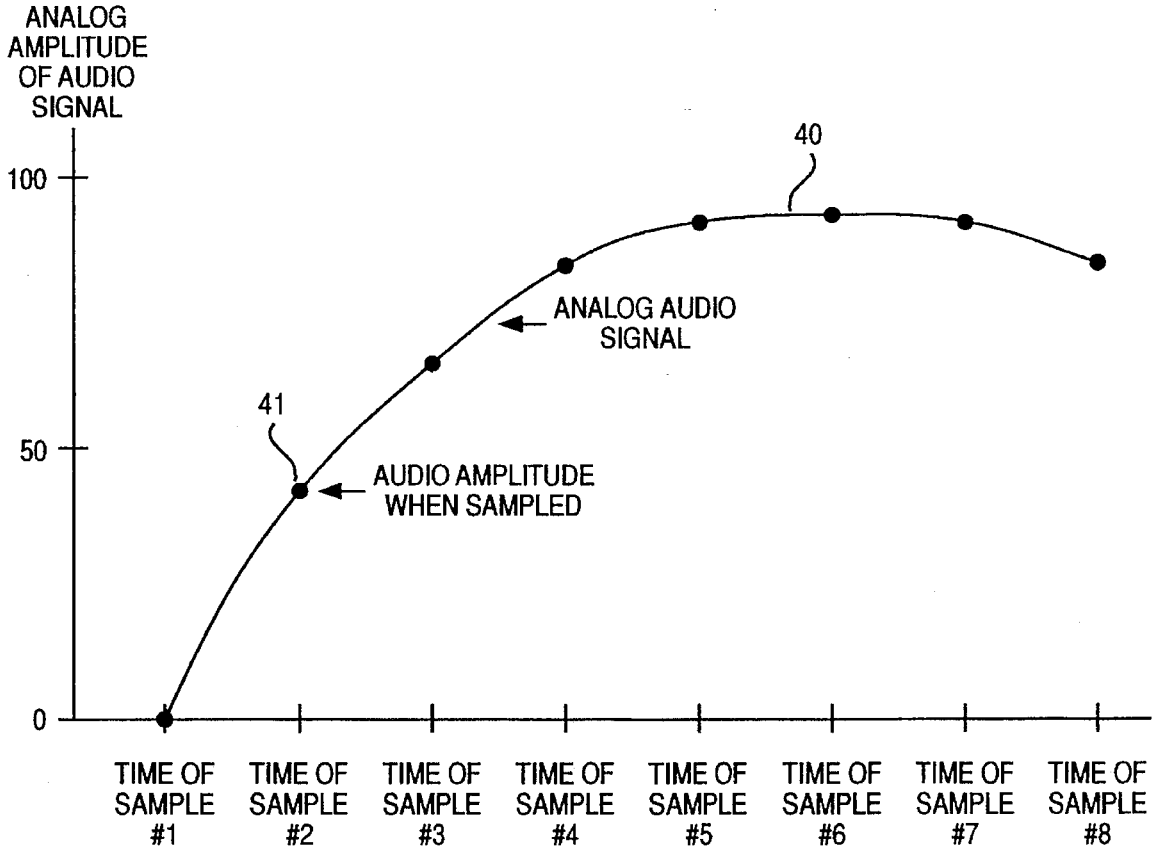

In FIG. 2, the set of violin samples 43 is stored in memory as a series of 16-bit data values. This storage could be different lengths, e.g., 8-bit, 12-bit, depending upon the desired quality of the audio signal. The box 45 to the right illustrates an example of data stored in the first 8 violin samples. The analog audio signal is later formed by creating an analog voltage level corresponding to the data values stored in box 45 at the sampling interval. The graph at the bottom shows the resultant analog waveform 40 created from these first 8 violin audio samples after the digital-to-analog conversion where data point 41 of this graph is an example of the data of box 45 at sample time #2.

The binary representation of the analog signal is measured in number of bits per sample; the more bits, the more accurate representation of the analog signal. For example, an 8-bit sample width divides the analog signal measurement into $2^8$ units meaning that the analog signal is approximated by 1 of a maximum of 256 units of measurements. A 8-bit sample width introduces noticeable errors and noise into the samples. A 16-bit sample width divides the analog signal measurement into $2^{16}$ units and so the error is less than 1 part in 64K, a much more accurate representation.

The number of samples per second determines the frequency content, the more samples, the increased frequency content. The upper frequency limit is approximately ½ the sampling rate. Thus, 44K samples per second produce an upper frequency limit of about 20 kHz, the limit of human hearing. A sample rate of 22K samples per second produce a 10 kHz upper limit, and high frequencies are lost and the sound appears muffled. The resultant audio signal, given the limits of sample width and sample rate, can thus follow the more intricate movements of an analog signal and reproduce the sound of the sampled musical instrument with extreme accuracy. However, extreme accuracy requires substantial data storage, one 4-second Violin sample recorded at 16-bits and 44K samples per second requires (4 seconds)×(2 audio channels for stereo)×(2 bytes for 16-bits)×(44,100 for 44K samples per second) or about 700 KB. Up to 5 or more violin samples may be needed to cover the entire pitch range of a violin meaning that 3500 KB are required just for one musical instrument. The samples for 4 violins would be another 3500 KB as would the samples for 12 violins. To cover all of the variations for all of the instruments of the orchestra represents a sizable amount of storage. Thus, the reader can appreciate the storage problems of the current audio synthesizer.

The present invention requires only the storage of a single violin. As discussed above, and in greater detail below, to obtain the sound of multiple violins, the digital processing micromanipulates the single violin sample to emulate the multiple violin sound.

Another advantage of this invention is that the sound of an exact number of instruments may be produced. Modern synthesizers may offer samples of 1 violin and of 30 violins, but not of intermediate numbers of violins due to the previously mentioned memory limitations. With this invention, the user may select the sound of any specific number of instruments, 10 violins for example, and the synthesizer will produce the appropriate sound. Small variations are introduced into the samples providing variation in the resultant sound. Sampling technology suffers from producing the exact same sound each time the sample is played back. The sound may be an accurate representation of the musical instrument, but the sound can become less interesting due to the lack of variation each time it is played back.

If the user wanted the sound of a single instrument, the digital processing could be effectively bypassed. Nonetheless, as an added advantage of the invention, the user may still want to digitally process the signal to introduce small variations and make the signal more interesting than prior art sampling technologies.

By "micromanipulating" the audio samples, the inventors intend to add small variations between the original audio sample and between the manipulated audio samples produced by the digital processors. The micromanipulations have to be sufficient to create a perceptible difference between the sample sets produced by two different processors. On the other hand, the micromanipulations must not be so great as to render the manipulated sample unrecognizable as the originally sampled instrument. The idea behind the invention is to produce the sound of many of the same instrument, not to produce the sound of many new and different instruments.

As mentioned above, a random number generator may be used in conjunction with this invention. Preferably, the random number is used as a seed for the digital processor; unless the degree of variation is small, entirely random processing for each sample would tend to create nonmusical sounds. From the random seed, the processor would determine the conditions to start the micromanipulation; the subsequent audio samples, the adjustments to the gain and so forth would flow from the initial starting conditions within the envelope chosen.

Figure 3:
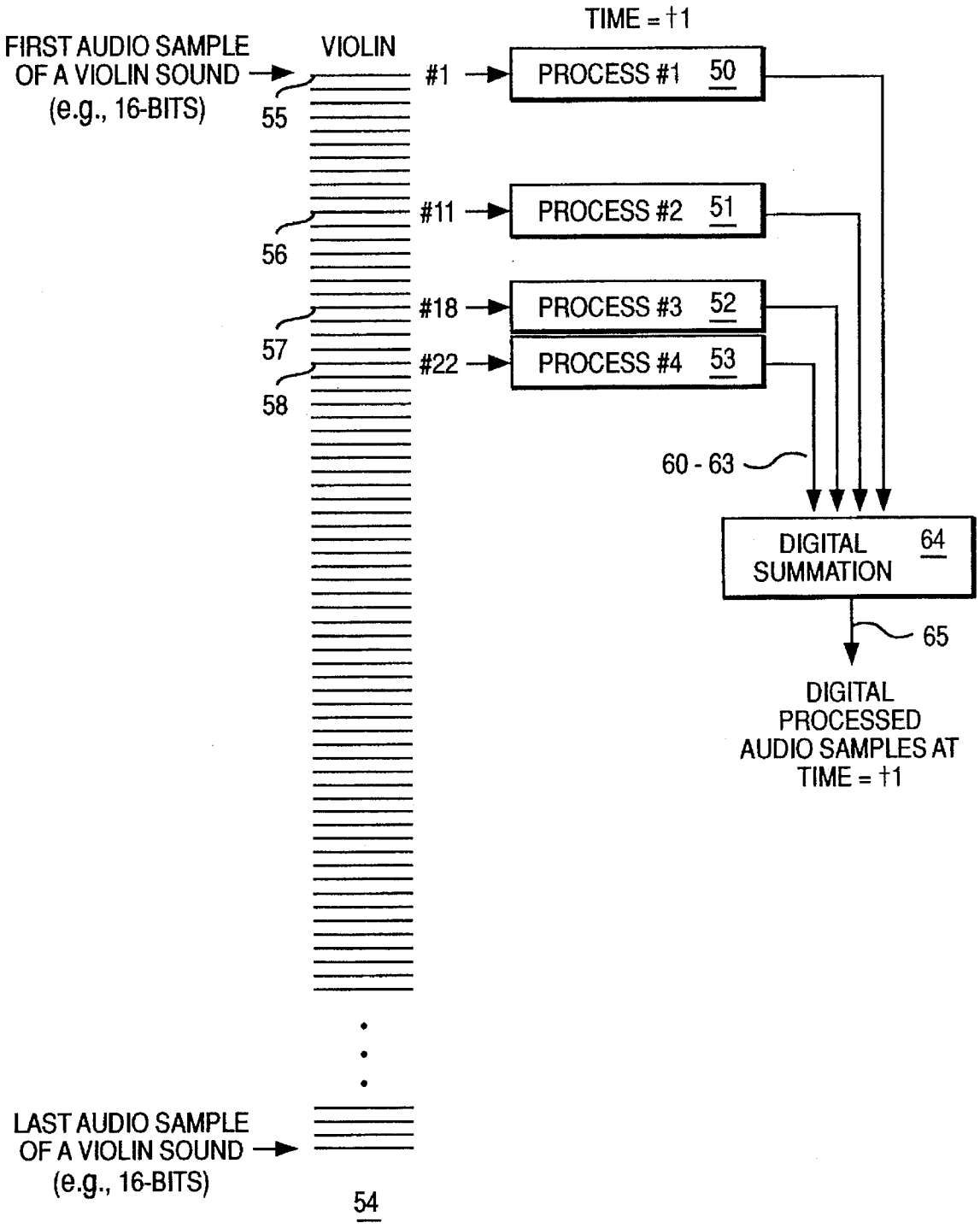
FIG. 3 depicts a more detailed diagram of the digital processing procedure.

FIG. 3 shows greater detail of the digital processing procedure. The number of processes or tone generators 50–53 are set up or called according to the number of instruments chosen by the user or application. From a set of violin samples 54, a corresponding number of individual violin samples 55–58 are fed to the processes 50–53, and individually processed in parallel. The resulting manipulated digital samples 60–63 are then summed digitally 64 to form the composite digital sample 65 for the sound of multiple violins at that point in time.

Time variations are introduced to simulate minor amplitude or pitch changes of specific simulated violins. The time variations may be influenced by a random number generator either as a seed or to introduce small random variations within a permitted envelope. The envelope dimensions are based on the input degree of variation. The digital processing has components that determine the specific values of gain, tone, and time variation. This process is repeated at successive times to form the composite sound of the multiple violins over time.

In FIG. 3, the user has input the requirement to create the sound of 4 violins from the sample of a lone violin. Processes #1–4 may manipulate each of the four samples using time variant Gain and Filter functions. The input or the degree of variation variable controls the data range over which these functions may vary.

As shown in the equations below, each process may modify the sample's gain, that is, its amplitude and tone by digital filtering.

At time=t1

$$\mathrm{Vsum}_1=\mathrm{Sample}_1 G_1(t_1)F_1(t_1)+\mathrm{Sample}_{11} G_2(t_1)F_2(t_1)+\mathrm{Sample}_{18} G_3(t_1)F_3(t_1)+\mathrm{Sample}_{22}(G_4(t_1)F_4(t_1)$$

where $\mathrm{Vsum}_1$ is the sum of the manipulated signals; $\mathrm{Sample}_1$, $\mathrm{Sample}_{11}$, $\mathrm{Sample}_{18}$ and $\mathrm{Sample}_{22}$ are amplitudes from the set of audio samples at particular instants in time; ($G_1(t_1)$, $G_2(t_1)$, $G_3(t_1)$ and $G_4(t_1)$ are time variant gain functions for each of the processors, at time $t_1$; and $F_1(t_1)$, $F_2(t_1)$, $F_3(t_1)$ and $F_4(t_1)$ are time variant filter functions at time $t_1$.

The gain functions at time=$t_1$ might be $G_1$=1.00, $G_2$=0.95, $G_3$=1.11, $G_4$=0.93 within the respective processes, thus emphasizing Sample #18 since gain is greater than 1.0 and deemphasizing Samples #11 and #22 since gain is less than 1.0. The gains at time=$t_2$ might be $G_1$=1.02, $G_2$=0.92, $G_3$=1.03, $G_4$=0.99 which is similar to t=$t_1$ but shows a slow variance. This micromanipulation would continue such that the samples that are emphasized and deemphasized vary over time as happens when 4 violin players play concurrently. Similar variations would occur in the filtering functions with time. The end result would be to vary the upper frequency content, and the pitch of the four instruments to simulate the minor tone variations produced by 4 violin players playing concurrently. Other processes could certainly be included to produce variation in the treatment of the samples. Time variations would be included to simulate the fact that 4 violin players never play exactly concurrently. It is important to note that the micromanipulations are time variant with respect to each other, so that the processes do not travel through time in lock step with each other. Although less preferred, one of the processes could be no change at all to the initial audio sample.

The degree of the variance is influenced by the user, but the distribution of this variance is controlled by the digital processing process. One example is to distribute the variance as a statistical "bell" curve about the norm, thus simulating the fact that most musicians play near the nominal condition while fewer and fewer musicians proportionally play at conditions approaching the outer limits of the distribution. The amount of variation between the individual simulated musical instruments is governed by the nature of the instruments and the taste of the user. The sound of multiple strings for example would allow more variation, i.e. a wider bell curve, than the sound of multiple clarinets, since the clarinet sound has a more distinct quality and would more easily appear "out of tune". In the preferred embodiment, the variations could adhere to a "bell" curve distribution, although other distributions are also appropriate, where the 3-sigma statistical variation is approximately 15% for amplitude, 30 cents (1 musical half-step is 100 cents) for pitch, and 30 milliseconds in time.

Figure 4:
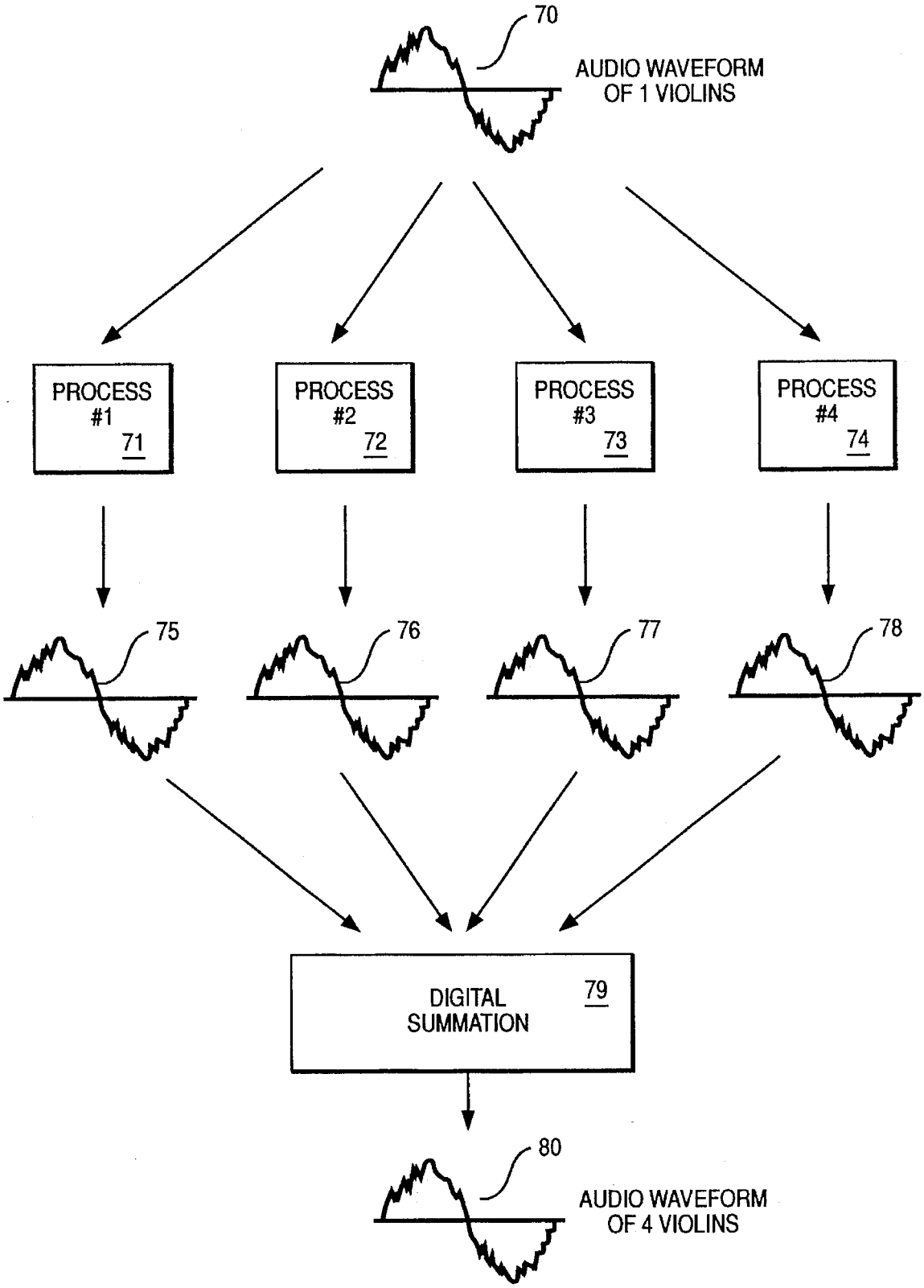
FIG. 4 depicts the digital samples generated by the digital processing procedure.

FIG. 4 illustrates the manipulation of the audio waveform represented by the samples of 1 violin when converted into the audio waveform represented 4 violins. The original audio waveform 70 of 1 violin is represented by the samples stored in memory. To generate the sound of 4 violins, 4 processes 71–74 are started in the digital processing procedure. Each process modifies the digital data representing the single violin sound as shown by the 4 "modified" audio waveforms 75–78. The audio waveforms shown represent the individual sounds of the 4 simulated "individual" violins. The digital data for the 4 modified audio waveforms digitally is then summed 79 to produce the digital data for a "group" of 4 violins, as represented by the audio waveform 80 for 4 violins.

As mentioned previously, the invention may be run on a general purpose computer equipped with a sound card or sound circuitry and appropriate software, or on a special purpose audio synthesizer. For example, computers in the IBM PS/2™, RS/6000™or PowerPC™series of computers equipped with an advanced sound card could be used in the present invention.

Figure 5:
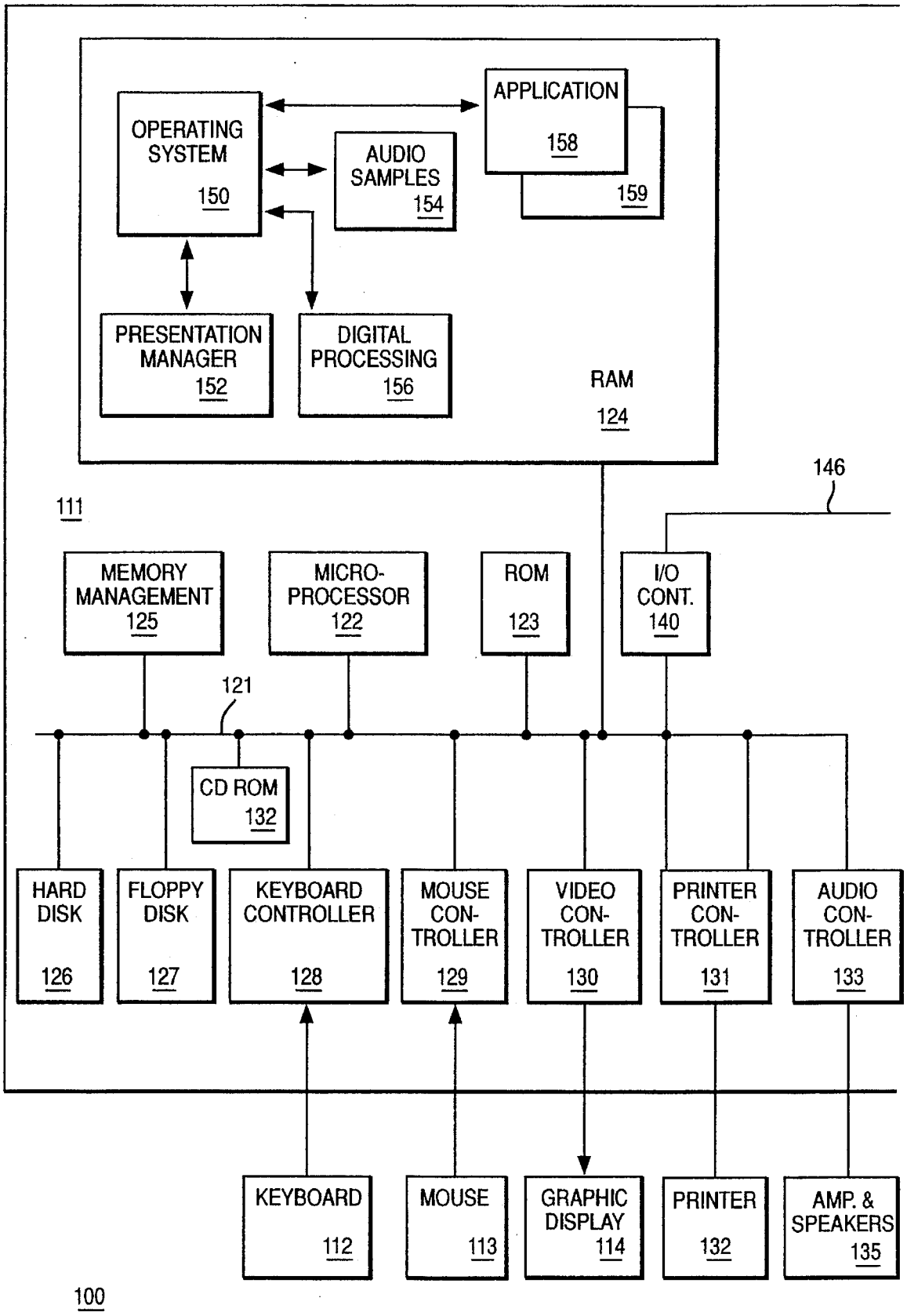
FIG. 5 illustrates a multimedia personal computer in which the present invention is implemented.

In FIG. 5, the components of 100, comprising a system unit 111, a keyboard 112, a mouse 113 and a display 114 are depicted. The system unit 111 includes a system bus or plurality of system buses 121 to which various components are coupled and by which communication between the various components is accomplished. The microprocessor 122 is connected to the system bus 121 and is supported by read only memory (ROM) 123 and random access memory (RAM) 124 also connected to system bus 121. A microprocessor in the IBM multimedia PS/2 series of computers is one of the Intel family of microprocessors including the 386, 486 or Pentium™microprocessors. However, other microprocessors including, but not limited to, Motorola's family of microprocessors such as the 68000, 68020 or the 68030 microprocessors and various Reduced Instruction Set Computer (RISC) microprocessors such as the PowerPC or Power 2 chipset manufactured by IBM, or other processors by Hewlett Packard, Sun, Intel, Motorola and others may be used in the specific computer.

The ROM 123 contains among other code the Basic Input-Output system (BIOS) which controls basic hardware operations such as the interaction and the disk drives and the keyboard. The RAM 124 is the main memory into which the operating system and application programs are loaded. The memory management chip 125 is connected to the system bus 121 and controls direct memory access operations including, passing data between the RAM 24 and hard disk drive 126 and floppy disk drive 127. The CD ROM 132 also coupled to the system bus 121 is used to store a large amount of data, e.g., a multimedia program or presentation.

Also connected to this system bus 121 are various I/O controllers: The keyboard controller 128, the mouse controller 129, the video controller 130, and the audio controller 131. As might be expected, the keyboard controller 128 provides the hardware interface for the keyboard 112, the mouse controller 129 provides the hardware interface for mouse 113, the video controller 130 is the hardware interface for the display 114, and a printer controller 131 is used to control a printer 132. The audio controller 133 is the amplifier and hardware interface for the speakers 135 which the processed audio signal to the user. An I/O controller 140 such as a Token Ring Adapter enables communication over a network 146 to other similarly configured data processing systems.

An audio card which uses the present invention, is discussed below in connection with FIG. 6. Those skilled in the art would recognize that the described audio card is merely illustrative.

The audio control card 133 is an audio subsystem that provides basic audio function to computers made by the IBM Corporation and other compatible personal computers. Among other functions, subsystem gives the user the capability to record and play back audio signals. The adapter card can be divided into two main sections: DSP Subsystem 202 and Analog Subsystem 204. The DSP Subsystem 202 makes up the digital section 208 of the card 200. The rest of the components make up the analog section 210. Mounted on the adapter card 200 is a digital signal processor (DSP) 212 and an analog coding/decoding (CODEC) chip 213 that converts signals between the digital and analog domains.

The DSP Subsystem portion 202 of the card handles all communications with the host computer. All bus interfacing is handled within the DSP 212 itself. Storage can be accommodated in local RAM 214 or local ROM 215. The DSP 212 uses two oscillators 216, 218 as its clock sources. The DSP 212 also needs a set of external buffers 220 to provide enough current to drive the host computer bus. The bidirectional buffers 220 redrive the signals used to communicate with the host computer bus. The DSP 202 controls the CODEC 213 via a serial communications link 224. This link 224 consists of four lines: Serial Data, Serial Clock, CODEC Clock and Frame Synchronization Clock. These are the digital signals that enter the analog section 204 of the card.

The analog subsystem 204 is made up of the CODEC 214 and a pre-amplifier 226. The CODEC 213 handles all the Analog-to-Digital (A/D) and Digital-to-Analog (D/A) conversions by communicating with the DSP 212 to transfer data to and from the host computer. The DSP 212 may transform the data before passing it on to the host. Analog signals come from the outside world through the Line Input 228 and Microphone Input 230 jacks. The signals are fed into the pre-amplifier 226 built around a single operational amplifier. The amplifier 226 conditions the input signal levels before they connect to the CODEC 213. In the future many of the components shown in the audio card may be placed on the motherboard of a multimedia enabled computer. The process may be performed by the computer and audio card depicted in FIGS. 5 and 6 respectively in a several different implementations. The storage of the audio samples and the micromanipulation processing may be accomplished by a software implementation in the main computer. Audio samples 154 and digital processing program 156 are stored in permanent storage on the hard disk 126 or a removable floppy disk placed in the floppy drive 127 and read into RAM 124. The processor 123 executes the instructions of the digital processing program to produce a new digitized sample for the plurality of instruments. The sample is sent to the audio card 133 where the signal is converted to analog signals which are in turn sent to the amplifier and speakers 135 to produce the actual sound which reaches the user's ears. The user may interact with the digital processing program 156 directly through the use of a graphical user interface to select the instrument, the degree of variance and the desired number of instruments. Alternatively, the user may interact with the user interface of an audio program 158 which makes the actual call to the digital processing program 156 with the required parameters.

In the alternative, the actual digital processing may be accomplished by the DSP 212 on the audio card 133. In this embodiment, the digital processing program would loaded into the DSP 212 or local RAM 214 from permanent storage at the computer. The audio samples may be stored in permanent storage at the computer or in local ROM 215. The digital processing would be accomplished by the DSP 212 which would send the digital sample to the CODEC 213 for processing to an analog signal. It would be likely that a portion of the digital processing program 156 would still be required at the computer to provide a graphical user interface or an interface to audio applications which request the digital processing services.

Those skilled in the art would recognize that other embodiments within a general purpose computer are possible.

Referring to FIG. 7, a graphical user interface (GUI) 290 is described as follows. The GUI action bar 295 is divided into three subsections: File I/O 300, Audio Information (302), and MIDI Information 303, respectively. When the File I/O option 300 is selected, an area 305 is devoted to displaying waveform data is shown. Various options on the pull-down would display different waveforms. For example, the input waveform data 310, that is, the original unmodified audio data, is shown when the input option 311 on the pull down is selected. The input waveform graph 310 represents this waveform data as a pictorial view of the spectrum plot. After alteration of the data occurs, a pictorial view of the spectrum plot is available in output data graph 320, a selection of the output option in the menu pulldown. This audio data represents the micromanipulated sample data. The file I/O menu pull down could also include a select instrument option.

The user may request modification of the audio sample by selecting the audio 301 and MIDI 303 section. Audio information is selected via a control box 330 which contains several controls 331–333, e.g., dials, set to some values. The dials may control a degree of variation value, a variable sampling rate (Fs), and a scaling factor for the envelope's amplitude for example. The selection of the MIDI option 303 causes MIDI controls 340, 350 to popup which contain yet other controls for, values for volume, MIDI ports, and Instrument Selection (timbre). As the user experiments while controlling Audio and MIDI control boxes 340, 350, the pictorial view of the audio waveform data 320 dynamically changes relative to the original audio input samples 310. One skilled in the art would recognize that many other GUIs could be used to control the process of the present invention. For example, a simple dialog box which contains entry fields for the instrument type, number of instruments and degree of variation might be used.

Figure 8:
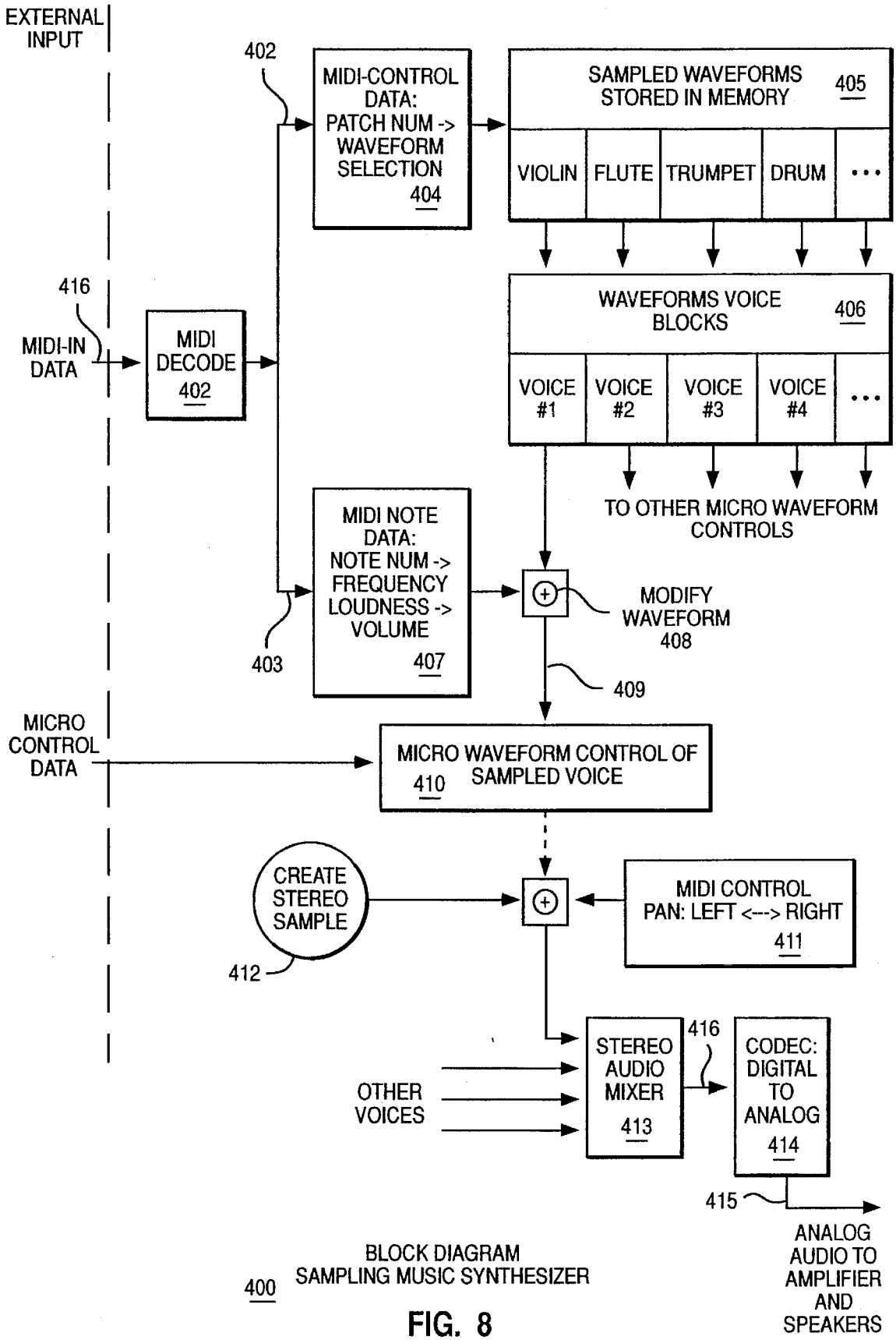
FIG. 8 is a block diagram of a music synthesizer in which the present invention is implemented.

In FIG. 8, a special audio synthesizer 400 Which is emulating an ensemble of instruments is depicted. MIDI data enters the synthesizer at its MIDI-IN connector 401 and is decoded by its MIDI decode circuitry 402. The MIDI data consists primarily of MIDI controls 402 and MIDI note data 403. From the MIDI control data 402, the MIDI control block 404 selects a sampled waveform from memory 405 for each of the synthesizer's voice blocks 406. In the example shown, the voice #1 block obtains a violin sample and the voice #2 block obtains a flute sample and so forth.

For the sake of simplicity, only the violin sample processing is depicted. Similar components exist for each of the other voices. From the MIDI note data 403, the MIDI note data block 407 determines the fundamental frequency of the note from the MIDI note command's key number and the volume of the note from the MIDI note command's velocity. This data is combined with the sample waveform from the voice block 406 modified by the Modify Waveform block 408. The result 409 in this example is a sample of a violin whose frequency and volume are determined by the MIDI note data and whose start and stop times are determined by the timing of the corresponding MIDI Note-ON command and Note-Off command.

The modified violin sample 409 is then modified by the Micro Waveform Control block 410 which generates the sound of multiple violins by the Digital Processing procedure as discussed above with reference to FIG. 3. The resultant set of audio samples is converted into separate stereo left and right channel samples by the Create Stereo Sample block 412 under control of the MIDI Control 411.

The other voices from the Waveform Voice Block 406 are treated in a manner similar to Voice #1, the violin, as described above. The stereo samples from all of these voices are combined by the stereo audio mixer 413 into one set of stereo audio samples 416. These samples are converted into a stereo analog signal 415 by the Codec digital-to-analog circuitry 414 and this analog signal is sent to an external audio amplifier and speakers (not illustrated) to be converted into sound.

The following pseudo code illustrates one possible embodiment of a portion of the algorithmic technique for a MIDI manipulation according to the present invention:

```
Ai(n) = Ari(n);
```

where (Ai(n) is the time-varying amplitude controller for the i the sample value, and r is some random factor; Fs is the sampling frequency. (Note: the digital storage of a waveform's amplitude range is assumed to be +/–32767 units where a table containing waveform amplitudes are assumed.)

```
Main()
{
    for(n=0;n<(Samples);n+ +){
    /*input number of samples for each instrument
    and amplitudes */
    I{n} := scanf(sample_time{n});
    old_audio_amp{n} := scanf(sample_amplitude{n};
    /* calculate amplitude threshold for each
    instrument by using */
    /* a factor associated with instrument
    amplitude_threshold{n} :=I{n}/(rand(factor*1.0),
    /* calculate randomized values */
    Call Random_amp(old_audio_amp{n},
    amplitude_threshold{n},
            randon_values{n};
    instr_new_amplitudes{n} :=random_values{n};
    /*output MIDI amplitude data */
    output_port(instr_new_amplitudes{n});
    }
  }
} /* end of main*/
-------------------------------
Procedure Random_amp(old_audio_amp{n},
amplitude_threshold{n},
            random_values{n});
{
    /*compute new, ransomized, Ai samples */
```

-continued

```
            Ai(n) = Ari(n);

    for(n=0;n<nSamples;n+ +) {
        random_values{n} :=
    amplitude_threshold{n}*(old_audio_amp{in}
    +instr_last_amplitudes{n} *
        instr_last_amplitudes{n});
    /*  save amplitude values for next iteration of samples */
        instr_last_amplitudes{n} := random_values{n};
    }
}/* end of Random_amp() */
```

While the invention has been shown and described with reference to particular embodiments thereof, it will be understood by those skilled in the art that the foregoing and other changes in form and detail may be made therein without departing from the spirit and scope of the invention.

We claim:

1. A method for producing a sound of a plurality of a selected instrument from a digitized audio sample of the selected instrument, comprising the steps of:

storing the digitized audio sample of the single selected instrument in a memory;

micromanipulating copies of the digitized audio sample in parallel in a plurality of digital processors corresponding in number to the plurality of the selected instrument, each digital processor processing the digital audio sample in a slightly different time variant manner;

summing the processed digital audio samples;

converting the summed digital audio sample to an analog signal and sending the analog signal to a speaker to produce the sound of the plurality of the selected instrument.

2. The method as recited in claim 1 further including the step of calling the plurality of digital processors in response to a selection of the number of the plurality of the selected instrument.

3. The method as recited in claim 1 further comprising the step of altering the processing of the plurality of digital processors in response to a degree of variation parameter.

4. The method as recited in claim 1 wherein the micromanipulating in each digital processor is at least in part performed according to a random number generator.

5. A system for producing a sound of a plurality of a selected instrument from a digitized audio sample of the selected instrument, comprising:

a memory for storing the digitized audio sample of the single selected instrument;

a plurality of digital processors for micromanipulating copies of the digitized audio sample in parallel, the plurality of digital processors corresponding in number to the plurality of the selected instrument, each digital processor processing the digital audio sample in a slightly different time variant manner;

means for summing the processed digital audio samples; and a digital to analog convertor for converting the summed digital audio sample to an analog signal which is sent to a speaker to produce the sound of the plurality of the selected instrument.

6. The system as recited in claim 5 further comprising a means for calling the plurality of digital processors in response to a selection of the number of the plurality of the selected instrument.

7. The system as recited in claim 5 further comprising means for altering the micromanipulating the plurality of digital processors in response to a degree of variation parameter.

8. The system as recited in claim 5 further comprising a random number generator wherein the processing in each digital processor is at least in part performed according to the random number generator.

9. The system as recited in claim 5 further comprising:

a system bus coupled to the memory for passing data and instructions between components in the system;

a display coupled to the system bus for presenting a user interface for control of the system, wherein a user makes inputs for the number of the plurality of the selected instrument and the degree of variation parameter.

10. The system as recited in claim 5 further comprising:

an audio card on which the digital to analog converter is placed.

11. The system as recited in claim 7 wherein an envelope in which the micromanipulating is bound is selected according to the degree of variation parameter.

12. The system as recited in claim 11 wherein the envelope is also selected according to the selected instrument.

13. A system for controlling the generation of the sound of a plurality of a selected instrument from a digitized audio sample of the selected instrument, comprising:

means for selecting the digitized audio sample from a memory;

means for selecting a number of the plurality of the selected instrument;

means for micromanipulating a corresponding number of copies of the digitized audio sample in parallel according to the number of the plurality of the selected instrument; and means for converting the micromanipulated copies of the digitized audio sample into a analog signal of the plurality of the selected instrument;

a speaker for receiving the analog signal and for producing the sound of the plurality of the selected instrument.

* * * * *